United States Patent [19]

Simmons

[11] Patent Number: 4,791,541

[45] Date of Patent: Dec. 13, 1988

[54] PROTECTIVE CAGE FOR A LAMP

[75] Inventor: Louis Simmons, Valparaiso, Ind.

[73] Assignee: Mc Gill Manufacturing Company, Inc., Valparaiso, Ind.

[21] Appl. No.: 90,573

[22] Filed: Aug. 28, 1987

[51] Int. Cl.[4] ..... F21V 15/00

[52] U.S. Cl. ..... 362/376; 362/378

[58] Field of Search ..... 362/378, 376, 377, 353

[56] References Cited

U.S. PATENT DOCUMENTS

| | | | |
|---|---|---|---|
| 445,259 | 1/1891 | Curtis et al. | 362/377 |
| 2,178,907 | 11/1939 | Hockley | 362/376 |
| 2,258,032 | 10/1941 | Popp | 362/378 |
| 2,533,812 | 12/1950 | Jones | 362/353 |
| 3,826,912 | 9/1974 | Pomroy | 362/378 |
| 3,835,311 | 9/1974 | Kramer | 362/376 |
| 4,086,482 | 4/1978 | Torgerson | 362/376 |
| 4,141,062 | 2/1979 | Trueblood | 362/378 |
| 4,275,435 | 6/1981 | Dorn | 362/378 |
| 4,321,660 | 3/1982 | Sokol | 362/378 |
| 4,369,487 | 1/1983 | Carlow | 362/378 |

*Primary Examiner*—E. Rollins Cross

[57] ABSTRACT

A single-piece lamp cage molded of plastic and adapted to be secured to a lamp socket to protect the lamp therein. The cage includes stationary and hinged cage sections connected to one another by a living hinge which permits the hinged section to be swung to an open position enabling changing of the lamp without need of removing the cage from the socket. A collar and a hinged clamp are molded integrally with the upper end of the stationary cage section and enable the cage to be installed on the socket without need of tools or hardware.

10 Claims, 2 Drawing Sheets

PROTECTIVE CAGE FOR A LAMP

BACKGROUND OF THE INVENTION

This invention relates to a guard or a cage for protecting an electric lamp which is screwed into an electrical socket. While the cage has many applications, it is particularly suitable for use in protecting a lamp which is screwed into a pigtail socket of the type used with temporary stringer lights.

SUMMARY OF THE INVENTION

The general aim of the present invention is to provide a new and improved lamp cage which may be used universally with electrical sockets produced by various manufacturers and which may be quickly and easily installed and removed without the use of tools or hardware.

Another object of the invention is to provide a lamp cage which is adapted to enable the lamp in the socket to be changed without need of detaching the cage from the socket.

A further object is to provide a relatively low cost lamp cage which is molded of plastic and which preferably is of single-piece construction.

The invention also resides in the provision of a cage with unique hinges and latches to enable easy installation of the cage and easy changing of the lamp.

These and other objects and advantages of the invention will become more apparent from the following detailed description when taken in conjunction with the accompanying drawings.

DETAILED DESCRIPTION OF THE PREFERRED EMBODIMENTS

Figure 1:
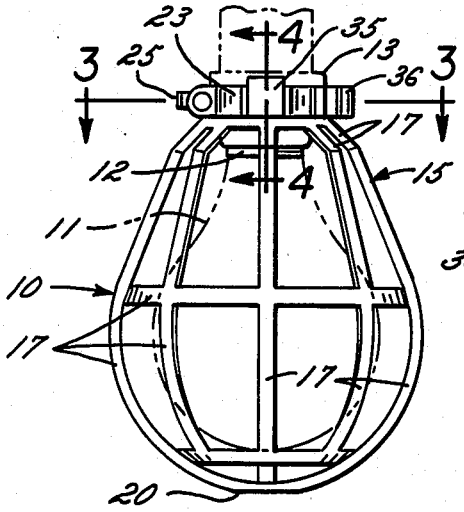
FIG. 1 is a front elevational view showing a socket and lamp equipped with a new and improved protective cage incorporating the unique features of the present invention.

For purposes of illustration, the present invention has been shown in the drawings in conjunction with a guard or cage 10 for protecting an electric lamp 11 having a base 12 screwed into an electrical socket 13. In this instance, the socket is of the so-called pigtail type and is adapted to be suspended from a temporary stringer of lights which might, for example, be strung around an outdoor concession stand.

In accordance with the present invention, the cage 10 is of one-piece molded plastic construction and is adapted to be secured easily to various types of sockets without need of tools or hardware. Moreover, the cage may be opened to permit changing of the lamp 11 without removing the cage from the socket 13.

Figure 6:
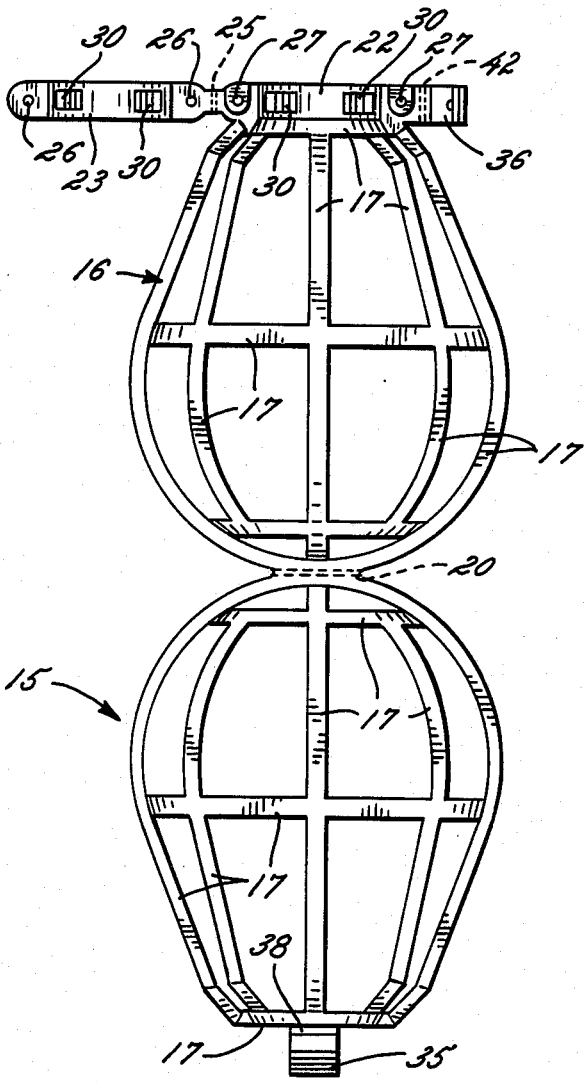
FIG. 6 is a front elevational view of the cage prior to installation.
Figure 7:
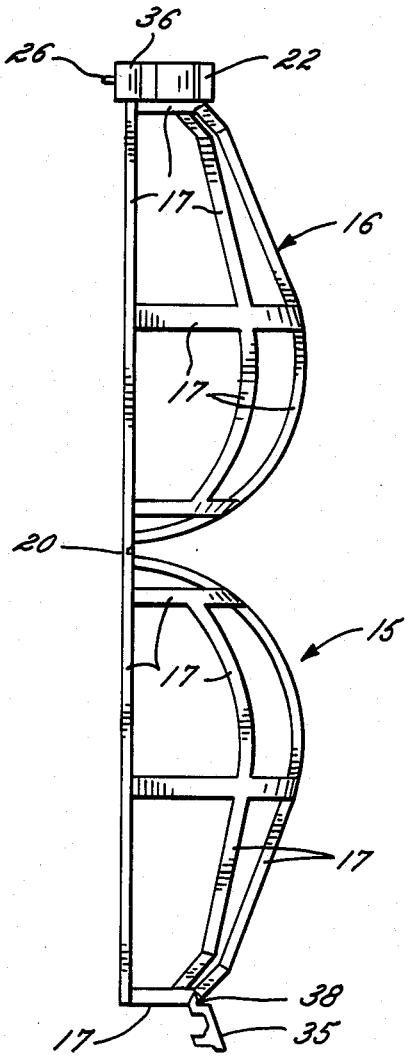
FIG. 7 is a side elevational view of the cage prior to installation.

More specifically, the cage 10 is molded of a relatively rigid but light weight plastic such as polypropylene and preferably is safety yellow in color. The cage corresponds generally in shape to the globe of the lamp 11 and, in large, is defined by two cage parts or halves 15 and 16 (see FIGS. 6 and 7). Each cage half is formed by a series of interconnected plastic strips 17 which form a protective gridwork around the globe of the lamp.

Figure 2:
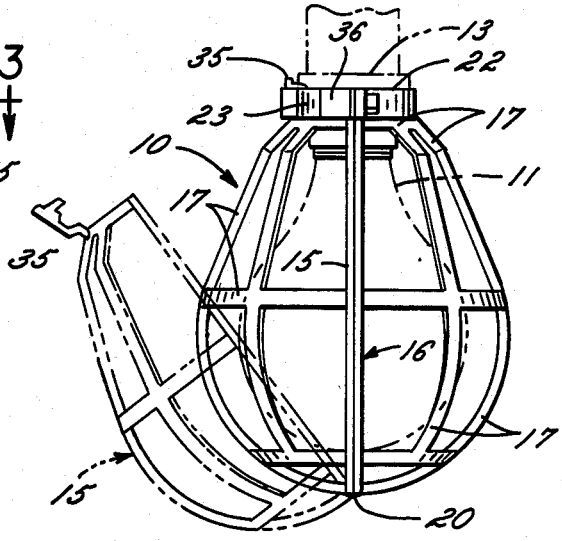
FIG. 2 is a side elevational view of the cage shown in FIG. 1.

Pursuant to the invention, the two cage halves 15 and 16 are integrally connected at their lower ends in such a manner as to enable the cage half 15 to swing between open and closed positions relative to the cage half 16. For this purpose, a horizontally extending living hinge 20 (FIGS. 2 and 7) is formed along the junction between the lower ends of the cage halves 15 and 16. The cage halves are molded while in the position shown in FIGS. 6 and 7 and, during such molding, the living hinge 20 is produced by forming a groove in the outer side of the plastic strip which connects the lower ends of the cage halves to one another. As a result of the hinge 20, the cage half 15 may be swung about a horizontal axis relative to the cage half 16 between a closed position shown in FIGS. 1 and 2 and an open position shown in FIGS. 6 and 7 and in phantom lines in FIG. 2. When the hinged cage half 15 is in its open position, the lamp 11 is exposed and thus may be easily unscrewed and removed from the socket 13.

Figure 5:
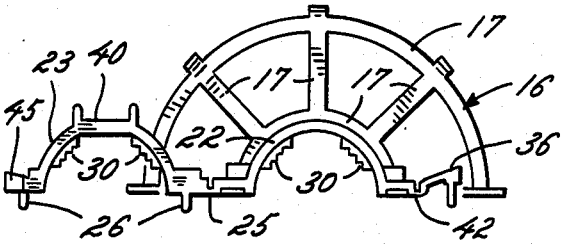
FIG. 5 is a top plan view which shows the cage after molding and prior to installation of the cage on the socket.

Further in keeping with the invention, means are formed integrally with the upper end portion of the stationary cage half 16 to enable the cage 10 to be easily attached to the socket 13 while still permitting the hinged cage half 15 to be swung to its open position relative to the stationary cage half 16. Herein these means comprise a generally semi-circular collar section 22 (FIGS. 3 and 5) molded integrally with the upper end of the stationary cage half 16 and adapted to extend around approximately one-half the circumference of the socket 13. A generally semicircular clamp section 23 extends around the remaining circumferential porton of the socket 13 and coacts with the collar 22 to clamp the cage 10 securely to the socket.

Advantageously, one end portion of the clamp 23 is connected to the adjacent end portion of the collar 22 by a living hinge 25 (FIGS. 3, 5 and 6) which permits the clamp to be swung about a vertical axis between closed and open positions relative to the socket 13 and the collar 22. Herein, the hinge 25 is formed by a thin web of plastic which extends vertically between two of the adjacent ends of the collar 22 and the clamp 23. When the clamp is swung to its closed position about the hinge 25, it embraces the socket 13 and causes the socket to be gripped between the clamp and the collar 22. Upon being swung to its open position shown in FIGS. 5 and 6 and in phantom lines in FIG. 3, the clamp 23 releases the socket 13 and permits the guard 10 to be pulled radially off of the socket.

Figure 3:
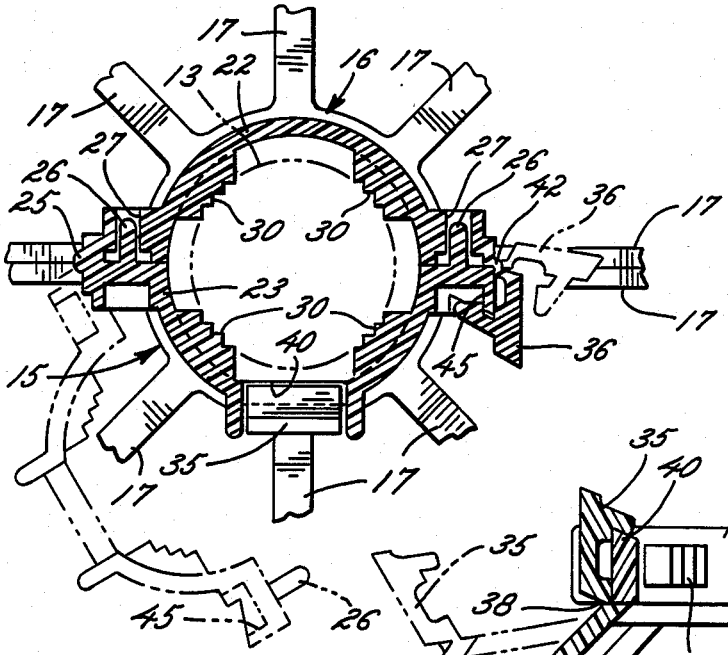
FIGS. 3 and 4 are fragmentary cross-sections taken substantially along the lines 3—3 and 4—4, respectively, of FIG. 1.

When the clamp 23 is swung to its closed position, dowels or pins 26 (FIG. 3) which are molded integrally with the clamp telescope into holes 27 formed in the collar 22. The pins 26 establish a positive connection between the collar 22 and the clamp 23 and reduce the stress imposed on the living hinge 25. The inner sides of the collar 22 and the clamp 23 are formed with inwardly projecting lugs 30 (FIGS. 3 and 5) whose inner sides are vertically serrated and define gripping surfaces which engage the socket 13. As shown in FIG. 3, the lugs are spaced approximately ninety degrees from one another and enable the cage 10 to be clamped to various types of sockets and to irregular sockets.

Figure 4:
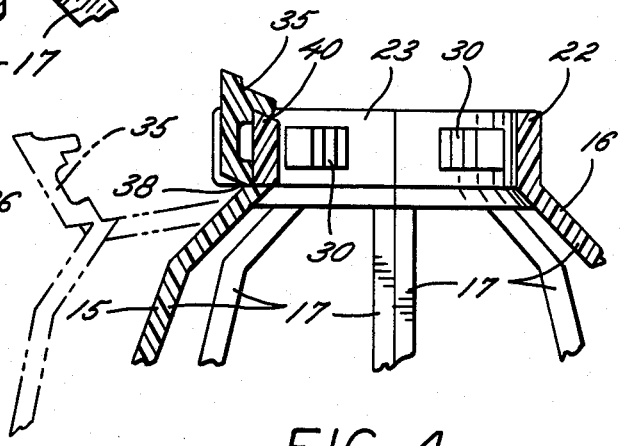

The cage 10 is completed by a latch 35 (FIG. 4) for releasably holding the hinged cage half 15 in its closed position and by a latch 36 (FIG. 3) for releasably holding the clamp 23 in its closed position. Herein, the latch 35 is connected to the upper end of the hinged cage section 15 to swing about a horizontal axis defined by a living hinge 38 (FIG. 4) located between the lower end of the latch and the upper end of the cage section. The hinge 38 is formed during the molding operation and supports the latch 35 to swing between a latched position shown in solid lines in FIG. 4 and an unlatched position shown in phantom lines. When the latch is in its latched position, it interlocks with a snap fit with a straight strike section 40 formed between the end portions of the clamp 23. The latch 35 thus coacts with the strike 40 to hold the hinged cage half 15 in its closed position relative to the stationary cage half 16.

As shown most clearly in FIG. 3, the latch 36 for the clamp 23 is connected integrally to one end of the collar 22 by a vertically extending living hinge 42 which is formed during the molding operation. The hinge 42 supports the latch 36 to swing from a latched position shown in solid lines in FIG. 3 to an unlatched position shown in phantom lines. A strike surface 45 (FIG. 3) is formed on the end of the clamp 23 and coacts with the latch 36 to releasably hold the clamp in its closed position. After the hinged cage half 15 has been swung to its open position, the latch 36 may be swung about the hinge 42 and released from the strike 45 and then the clamp 23 may be swung to its open position about the hinge 25 to free the cage 10 for removal from the socket 13.

From the foregoing, it will be apparent that the present invention brings to the art an easily manufacturable lamp cage 10 which may be quickly and easily attached to and removed from the socket 13 without need of any tools or any hardware. If a more secure and permanent attachment is required, the pins 26 may be removed and replaced with self-tapping screws adapted to thread into the holes 27.

I claim:

1. A guard for protecting an electrical lamp having a base adapted to be inserted into an electrical socket, said guard being of one-piece construction and being molded of plastic, said guard comprising a hinged cage part and a stationary cage part, a living hinge interconnecting adjacent ends of said cage parts and supporting said hinged cage part to swing between closed and open positions with respect to said lamp, said cage parts enclosing said lamp when said hinged cage part is in said closed position, said hinged cage part exposing said lamp when in said open position and being located to permit said lamp to be removed from said socket and from said stationary cage part, first coacting latch means integral with said cage parts and operable to releasably hold said hinged cage part in said closed position, a collar section integral with the end of said stationary cage part opposite said hinge and shaped to extend around a portion of said socket, a clamp section shaped to extend at least substantially around the remaining portion of said socket, a living hinge connecting said clamp section to said collar section and supporting said clamp section to swing between closed and open positions, said clamp section coacting with said collar section to embrace said socket and hold said guard on said socket when said clamp section is in its closed position, said clamp section exposing said socket when in said open position and being located so as to enable said guard to be pulled away from said socket, and second coacting latch means integral with said collar section and said clamp section and operable to releasably hold said clamp section in its closed position.

2. A guard as defined in claim 1 in which said first latch means comprise a strike on said clamp section and further comprise a latch on said hinged cage part, and a living hinge connecting said latch to said hinged cage part and supporting said latch to swing between latched and unlatched positions with respect to said strike.

3. A guard as defined in claim 1 in which said second latch means comprise a strike on said clamp section and further comprise a latch on said collar section, and a living hinge connecting said latch to said collar section and supporting said latch to swing between latched and unlatched positions relative to said strike.

4. A guard as defined in claim 2 in which said second latch means comprise a second strike on said clamp section and a second latch on said collar section, and a living hinge connecting said second latch to said collar section and supporting said second latch to swing between latched and unlatched positions with respect to said second strike.

5. A guard as defined in claim 1 further including dowel means projecting from one of said sections, and hole means formed in the other of said sections, said dowel means being telescoped into said hole means when said clamp section is in its closed position.

6. A guard as defined in claim 5 in which said dowel means comprise first and second pins projecting from said clamp section, said first and second pins being located adjacent the hinged end and the free end, respectively, of said clamp section, said hole means comprising first and second holes formed in said collar section and located to telescopically receive said first and second pins, respectively.

7. A guard as defined in claim 1 further including a first pair of angularly spaced lugs on said collar section, and a second pair of angularly spaced lugs on said clamp section, said lugs being operable to grip said socket when said clamp section is in its closed position.

8. A guard as defined in claim 7 in which said lugs are spaced approximately ninety degrees from one another around said socket when said clamp section is in its closed position.

9. A guard for protecting an electrical lamp having a base adapted to be inserted into a socket, said guard being of one-piece construction and being molded of plastic, said guard comprising a hinged cage part and a stationary cage part, a living hinge connecting one end of said hinged cage part to one end of said stationary cage part and supporting said hinged caged part to swing between closed and open positions with respect to said stationary cage part, said cage parts enclosing said lamp when said hinged cage part is in said closed position, said hinged cage part exposing said lamp when in said open position and permitting said lamp to be removed from said socket and from said stationary cage part, a latch on one of said cage parts, a strike on the other of said cage parts, a living hinge connecting said latch to said one cage part and supporting said latch to swing between latched and unlatched positions with respect to said strike, said latch and said strike coacting to hold said hinged cage part in said closed position when said latch is in said latched position and freeing said hinged cage part to swing to said open position when said latch is in said unlatched position, a collar section integral with one end of said stationary cage part and shaped to extend around a portion of said socket, a clamp section shaped to extend at least substantially around the remaining portion of said socket, a living hinge connecting said clamp section to said collar section and supporting said clamp section to swing between open and closed positions, said clamp section coacting with said collar section to grip said socket and hold said guard on said socket when said clamp section is in its closed position, said clamp section releasing said socket when in said open position and being located so as to enable said guard to be pulled away from said socket, a second latch on one of said sections, a second strike on the other of said sections, and a living hinge supporting said second latch to swing between latched and unlatched positions with respect to said second strike, said second latch and said second strike coacting to hold said clamp section in its closed position when said second latch is in its latched position and freeing said clamp section to swing to its open position when said second latch is in its unlatched position.

10. A guard as defined in claim 9 in which said first latch and said first strike are on said hinged cage part and said clamp section, respectively, said second latch and said second strike being on said collar section and said clamp section, respectively.

* * * * *